United States Patent [19]

Buse

[11] 4,159,060

[45] Jun. 26, 1979

[54] TRANSFER UNIT AND METHOD OF MOVING STACKED LUMBER AND THE LIKE

[76] Inventor: Norman M. Buse, 18922 View Pl., Stanwood, Wash. 98292

[21] Appl. No.: 871,256

[22] Filed: Jan. 23, 1978

[51] Int. Cl.[2] ..... B66F 9/12

[52] U.S. Cl. ..... 414/608; 414/607; 414/786

[58] Field of Search ..... 214/620, 621, 512, 515, 214/310, 152, 10.5 R

[56] References Cited

U.S. PATENT DOCUMENTS

| | | | |
|---|---|---|---|
| 2,432,182 | 12/1947 | Turner | 214/515 X |
| 3,883,020 | 5/1973 | Dehn | 214/515 |

FOREIGN PATENT DOCUMENTS

| | | | |
|---|---|---|---|
| 467796 | 8/1950 | Canada | 214/621 |
| 926058 | 3/1955 | Fed. Rep. of Germany | 214/621 |
| 1182079 | 11/1964 | Fed. Rep. of Germany | 214/621 |
| 68034 | 3/1958 | France | 214/515 |
| 758223 | 10/1956 | United Kingdom | 214/621 |

*Primary Examiner*—Frank E. Werner
*Attorney, Agent, or Firm*—Graybeal, Barnard & Uhlir

[57] ABSTRACT

A method of moving and transferring a stack of lumber or the like from a side by side row of stacks wherein the stacks are supported on ground placed chocks positioned at the ends of the stack. The method involves engaging with the tines of a forklift truck a transfer unit provided with a ground engaging support means at its forward end, and lifting the transfer unit with the lift truck tines so that the transfer unit is at least partially maneuverable by movement of the lift truck. The transfer unit is then forwardly and progressively moved under the selected stack by forward movement of the lift truck so that the transfer unit engages the stack and pushes the near chock forwardly and beyond the center of the stack so that the weight of the stack is transferred from the chocks to the transfer unit. The transfer unit supported stack is then withdrawn from the row of stacks by backing the lift truck away from the row. The lift truck tines are then lowered to a point where the transfer unit is fully ground supported, and the lift truck repositioned to where the tines can engage the transfer unit suppported stack from the side, and lift and transport it to a storage location away from the row of stacks.

13 Claims, 8 Drawing Figures

TRANSFER UNIT AND METHOD OF MOVING STACKED LUMBER AND THE LIKE

BACKGROUND OF THE INVENTION

1. Field of the Invention

This invention relates to a means and method of moving and transferring a stack of lumber or the like from a row of stacks wherein the the stacks are arranged close together in a side-by-side relationship.

2. Description of the Prior Art

In a sawmill or lumber yard environment, sawn lumber units move sidewise on a so-called "green line" to a stacking area where they are manually removed one by one from the line, inspected as to size and the like, and stacked by size and the like to form a row of closely spaced, side-by-side stacks adjacent the line. When a sufficient quantity of a particular size lumber has been accumulated in a stack, that stack must be quickly removed from the line and stacking area, and transported to a storage location within the yard. In the past these stacks of sorted lumber were moved away from the line and other adjacent stacks by means of carts or straddle trucks.

With the use of carts, typically multi-wheeled low profile vehicles, the lumber which has been sorted was stacked directly upon a wheeled cart. When a sufficient quantity of lumber had been stacked, the cart was pulled from the line to a storage location within the lumber yard, and a second cart was inserted in its place within the stacking area adjacent the line. This method of moving and transferring a stack of lumber necessitated the use of a multiplicity of carts to accommodate the numerous stacks of sorted lumber adjacent the line and those stored at locations within the yard.

With the use of straddle trucks, adjacent stacks of sorted lumber had to be spaced far apart to enable the truck to maneuver around and above the stack to be removed. Since these stacks are sorted and stacked manually, the increased distance between adjacent stacks increased the stacking time. When a sufficient quantity of sorted lumber had been accumulated in a stack, the straddle truck removed the stack from the line and delivered it to storage within the yard. This meant the truck had to leave the vicinity of the stacking area further increasing the stacking time. Finally, straddle trucks per se are expensive and complicated pieces of equipment and are subject to the relatively complicated maintenance problems associated with such equipment.

As will be discussed more fully, the means and method of moving and transferring a stack of lumber according to the present invention overcomes these limitations of prior stack moving practice. The present invention provides a transfer unit comprising an essentially rigid rectangular frame slightly wider than a stack of sorted lumber and roller supported at one end. The frame is progressively moved by forklift truck under a selected stack such that the weight of the stack is eventually supported by the frame. The frame and stack may then be withdrawn from the line where the forklift truck can remove the stack from the frame and transport it to a storage location within the yard. The same frame may then be repositioned under another selected stack and the process repeated.

SUMMARY OF THE INVENTION

According to one aspect of the present invention, the means of moving and transferring a stack of lumber or the like comprises an essentially rectangular frame with side members spaced apart a distance slightly wider than the stack to be moved. Cross-members are spaced at intervals along the length of the side members, with certain cross-members providing a pocket means at one end of the frame for receiving the tines of a forklift truck whereby the frame can be engaged and lifted by the tines. Ground engaging roller means are journaled between the side members at the opposite end of the frame. Stack engaging and supporting elements are superimposed across the frame along its length, with one such element being in the form of a roller means spanning the roller supported end of the frame so that, as the transfer unit is progressively moved under the stack, the weight of the stack is progressively transferred to such roller means and the other supporting elements and the stack can then be withdrawn from a row of stacks by elevating the transfer unit simply by raising the tines of the forklift and backing the forklift truck away from the stacks.

According to another aspect of the present invention the method of moving and transferring a stack of lumber or the like involves engaging a transfer unit provided with a ground engaging support roller means with the tines of a forklift truck and slightly lifting the engaged transfer unit with the tines so that at least a portion of the unit is carried by and is maneuverable by movement of the lift truck. The truck and engaged transfer unit are then aligned in an end position with respect to the stack selected for removal which is supported at each end by ground placed chocks. The transfer unit is then forwardly and progressively moved under the stack by forward movement of the lift truck so that the weight of the stack is transferred to the transfer unit. The transfer unit supported stack is then removed from the row of stacks by backing the truck and partially tine supported transfer unit to a point where the transfer unit is clear of the row. The lift truck tines are then lowered to a point where the transfer unit is entirely ground supported, the tines disengaged from the unit, and the lift truck positioned on one side of the unit where the tines engage and remove the stack from the transfer unit for transportation to a storage location away from the row of stacks.

It is a significant feature and advantage of the present invention that a single transfer unit is required, with the unit at all time remaining in the stacking area and in close proximity to the "green line". Additionally, since the width of the transfer unit is only slightly wider than a stack to be removed, adjacent stacks of lumber or the like may be arranged in very close side-by-side relationship, to make the "green line" as short as possible.

The foregoing and other objects, features and advantages of the present invention will become more apparent in the light of the following detailed description of preferred embodiments thereof, as illustrated in the accompanying drawings.

DESCRIPTION OF THE PREFERRED EMBODIMENT

Figure 1:
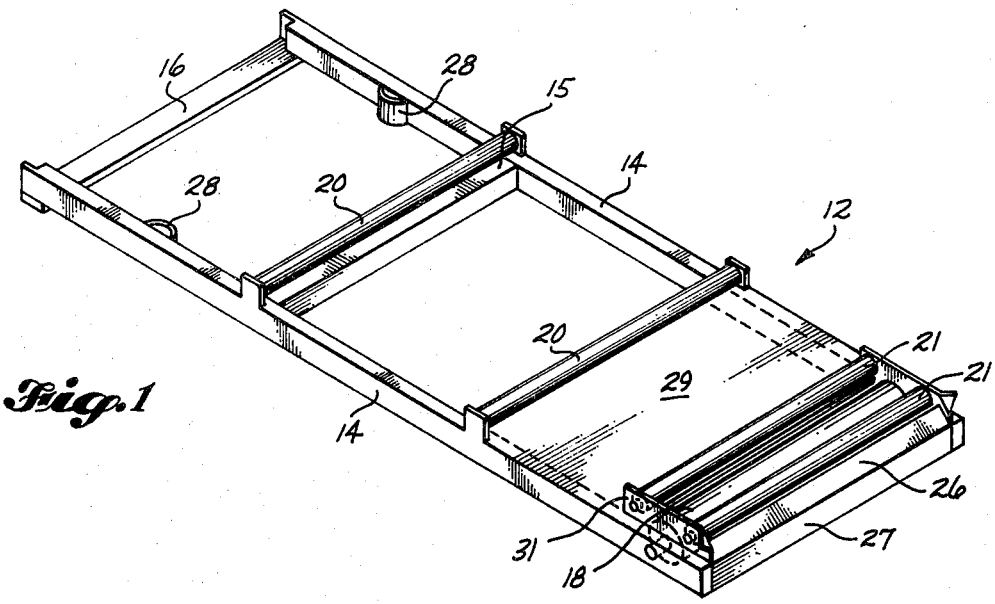
FIG. 1 is a perspective view of the forward end of one embodiment of a typical transfer unit according to the present invention.
Figure 2:
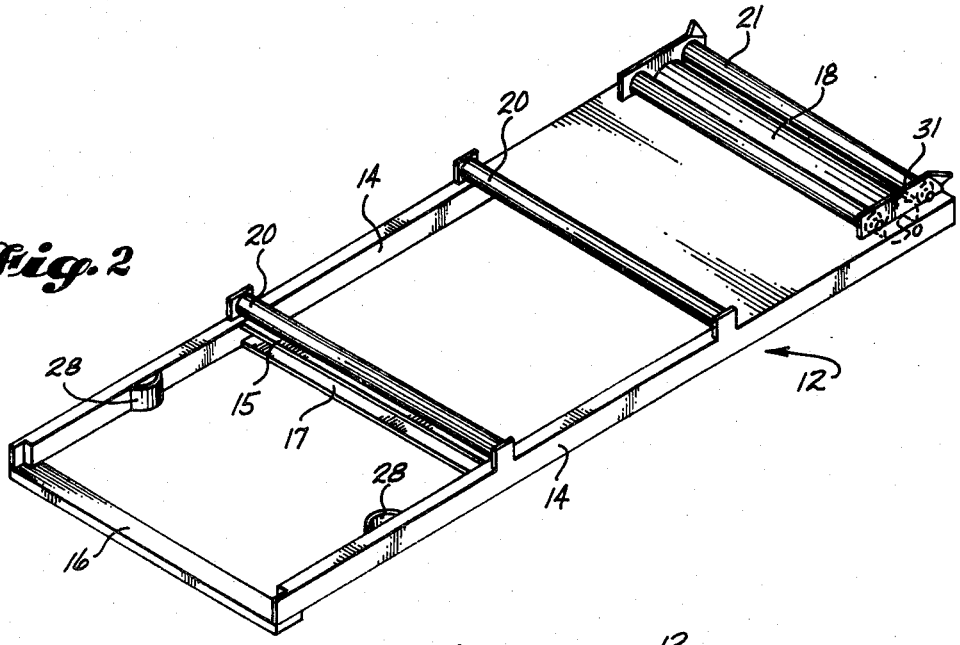
FIG. 2 is a perspective view of the other end of one embodiment of a typical transfer unit according to the present invention.

In one embodiment of the present invention, as shown in FIGS. 1–4, the transfer unit comprises an essentially rigid rectangular frame 12 including side members 14 and a plurality of cross-members 16. Certain cross-members 15 and 17, in conjunction with the side members 14, form a pocket means disposed at one end of the frame 12 for receiving the tines of a forklift truck therein. A ground engaging roller means 18 is journaled between side members 14 and is disposed at the forward end of the frame 12. A plurality of stack engaging and supporting elements 20 and 21 are superimposed across the frame 12 at intervals along the length thereof.

Side members 14 are essentially rigid, elongate members constructed from any suitable material such as steel or the like. Side members 14 must be of a length such that when the transfer unit is inserted under the stack to be moved, as will be discussed below, the forward end of the unit extends beyond the midlength of the stack, causing the weight of the stack to be transferred to the transfer unit. It is to be understood that although side members 12 are shown as having an essentially rectangular cross-section, any suitable substantially rigid cross-sectional geometry may be utilized to practice the present invention.

A plurality of cross-members 16 maintain the side members 14 of the transfer unit in rigid, spaced apart relation. The length of the cross-members 16 must be sufficient to space the side members 14 apart a distance slightly wider than the stack to be removed. Cross-members 16 are disposed at intervals along the length of the side members 14 and are rigidly secured thereto by suitable fastening means, as by welding. Certain cross-members 15 and 17 are disposed between the side members 14 at a point from the time engaged end of the unit generally equivalent to the length of the tines 22 of a forklift truck 24, which truck may be conventional per se. Cross-members 15 and 17, in conjunction with the side members 14, provide a pocket means for receiving and engaging the tip portion of tines 22. In this manner, the transfer unit can be engaged, partially lifted, and partially supported at one end by the tines. A plurality of tine steering and position guides 26 are disposed upon and along the inside surface of the side members 14 between the pocket and the tine engaged end of the frame 12, and ensure the tines and truck 24 maintain an end aligned relation with the frame as the tips of the tines engage the unit. Cross-members 16 are suitably constructed of any suitable essentially rigid material, such as steel or the like.

A ground engaging roller means 18 is journaled between the side members 14 and is disposed at the forward end of the frame 12. As shown in FIGS. 1–4, the roller means 18 comprises a drum, but it is to be understood that other ground engaging means are suitable, such as a plurality of wheels or the like, for the invention. The diameter of the roller means 18 is advantageously slightly greater than the height of frame 12 and slightly less than the height of the stack supporting chocks 32 (see FIG. 4), as further discussed below. Means for rotatably securing the roller journals (not shown) and the ground engaging roller 18 to the side members 14 are old per se. In the presently preferred embodiment, the roller means 18 is constructed from a suitable hard rigid material such as steel or the like.

A plurality of stack engaging and supporting elements 20, 21 are superimposed across the frame 12 at intervals along the length thereof. In the presently preferred embodiment, elements 20 are generally half round shaped rigid members secured to side members 14, as by welding or the like. It is to be understood that any suitable shape for elements 20 may be utilized in practice of the invention. Stack engaging and supporting elements 21 are roller means which span the forward end of the frame 12 and are disposed above and around the ground engaging roller means 18. The height of the roller elements 21 is slightly greater than the height of the stack supporting chocks 32. In this manner, as the transfer unit is progressively moved under a chock supported stack 30, the weight of the stack is progressively transferred from the chock 9 to the roller means 21, and other supporting elements 20. Roller means 21 are rotatably journaled to side members 14 by means (not shown) which are old per se. The stack engaging and supporting elements are suitably constructed from strong material such as steel or the like.

A solid rigid, sloping ramp member 26 is disposed across and upon the side members 14 at the forward end of the frame 12. The sloping ramp member 26 forms an acute angle (suitably about 45° from horizontal) with respect to the side members 14 and extends above the side members 14 to a height slightly less than that of the roller means 21. A cross-member 27 disposed across the forward end of the frame 12 and below sloping ramp member 26 prevents ground placed chocks 32 from becoming engaged with the ground engaging roller means 18 as the transfer unit is moved under the selected stack. A plurality of stack girding members 31 are disposed on either side of the sloping ramp member 26 and upon the side members 14. The guide members 31 extend slightly above and slightly forwardly of the sloping ramp member 26 and have a flaired portion 33 therein. The width of the flaired portion is slightly wider than the sloping ramp member 26 and the stack to be removed. The sloping ramp member 26, cross member 27, and guide members 31 are suitably constructed of any suitable strong material such as steel or the like.

A plate 29 superimposed across the frame 12 and rigidly secured thereto provides additional strength and rigidity to the forward end of the frame. The plate 29 is suitably constructed of any strong material such as steel or the like.

Figure 5:
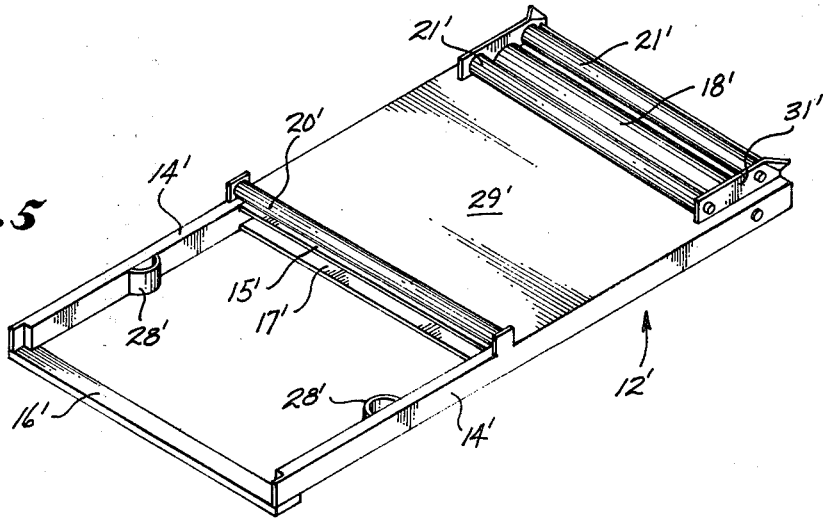
FIG. 5 is a perspective view of the forward end of another embodiment of a typical transfer unit according to the present invention.

A second embodiment of a transfer unit, as shown in FIG. 5, comprises an essentially rigid rectangular frame 12' including side members 14' and a plurality of cross-members 16'. As in the preferred embodiment, certain cross-members 15' and 17' in conjunction with the side members 14' form a pocket means disposed at one end of the frame 12' for receiving the tines of a forklift truck therein. A ground engaging roller means 18' is journaled between the side members 14' and is disposed at the forward end of the frame 12'. A plurality of stack engaging and supporting elements 20' and 21' are superimposed across the frame 12' at intervals along the length thereof.

The second embodiment differs somewhat from the preferred embodiment as described in that the side members 14' are shorter than the corresponding side members 14 of the preferred embodiment. In this manner, the transfer unit may more easily move and tranfer shorter stacks of lumber, or the like, as described below.

Figure 6:
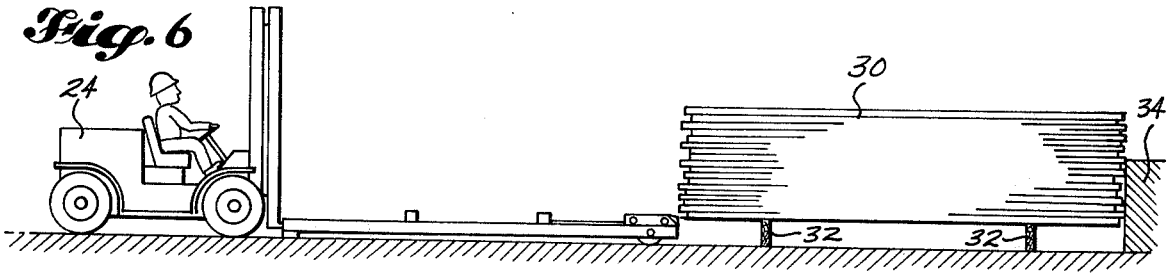
FIG. 6 is a pictorial somewhat schematic representation, showing the typical initial steps of moving and transferring a stack in accordance with the present invention.
Figure 7:
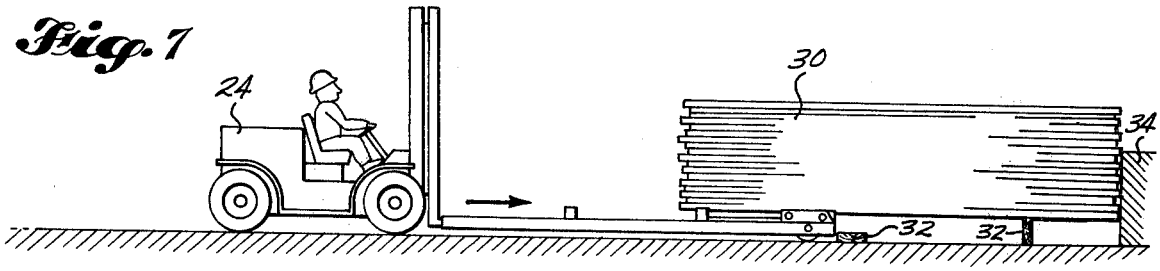
FIG. 7 is a further pictorial representation showing additional typical steps in moving and transferring a stack in accordance with the present invention.
Figure 8:
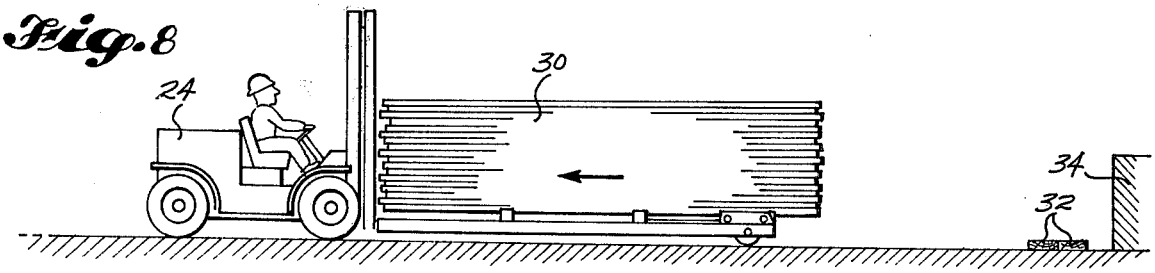
FIG. 8 is a further pictorial representation showing still further typical steps in moving and transferring a stack in accordance with the present invention.

The method of moving and transferring a stack of lumber is shown schematically in FIGS. 6–8. In a typical sawmill or lumber yard environment, sawn lumber is moved in a sidewise manner into a stacking area on a "green line" (not shown) where it is manually removed from the line, sorted as by size, and stacked to form a row of stacks. Adjacent stacks of lumber shown generally at 30 are arranged close together in a side-by-side relationship (note FIG. 3) and are supported on ground-placed supporting chocks 32 at each end. Stack supporting chocks 32 are typically of a height less than that of the transfer unit. In a typical stacking area, a reaction wall 34 is generally disposed between the "green line" and the row of stacks.

When a sufficient quantity of sorted lumber has been accumulated into a given stack 30, it is selected for removal from the row of stacks to a storage location within the yard. With reference to FIGS. 6–8, the tines 22 of forklift truck 24 engage the pocket and cross-members 15 and 17 of the transfer unit. Tine steering and positioning guides 28 aid the tines to maintain an end aligned relation with respect to the transfer unit.

Forklift tines 22 then lift the engaged transfer unit so that the transfer unit is at least partially carried by and maneuverable by the movement of the lift truck 24 and the ground engaging means 18 disposed at the forward end of the frame 12. The lift device 24 then moves the transfer unit into an end aligned ground engaged position with respect to the stack 30 selected for removal.

As the transfer unit is forwardly and progressively moved under the selected stack 30, by forward movement of the lift device 24, the sloping ramp member 26 engages and deflects the near end of the stack 30 in an upward manner. During this time the stack is suitably restrained against substantial rearward movement, as by engagement with the reaction wall 34. As the transfer unit is progressively moved under the stack 30, the roller elements 21 permit the stack 30 to partially engage and become supported by the stack supporting elements 20. As the transfer unit is still further progressively moved forwardly under the stack 30, side frame members 14 and cross-members 16 contact a stack supporting chock 32 which is progressively pushed toward and beyond the center of the stack. As this occurs, the weight of the stack 30 is transferred from the chocks 32 to the transfer unit and the stack engaging and supporting elements 20. The transfer unit is progressively moved forwardly under the stack 30 until the weight of the stack is completely transferred from the chocks 32 to the transfer unit.

At this point, the transfer unit supported stack is withdrawn from the row of stacks by backing the lift truck 24 and the tine engaged transfer unit from the row of stacks to a point where the unit supported stack is clear of the row. The tines 22 are lowered to a point where the transfer unit is entirely ground supported, at which time the tines are disengaged from the transfer unit pocket.

Figure 3:
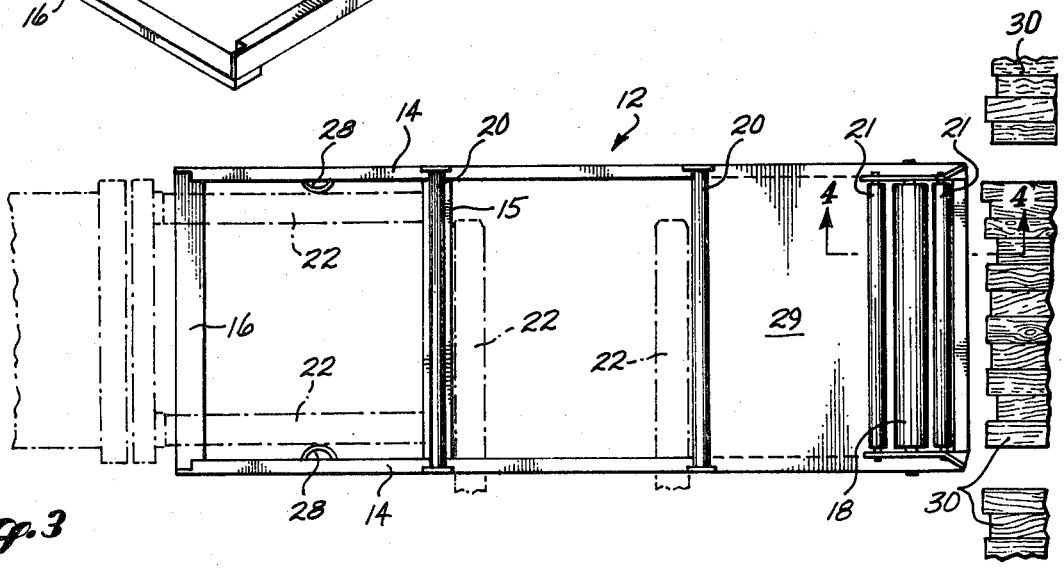
FIG. 3 is a top view of one typical embodiment of a transfer unit according to the present invention.
Figure 4:
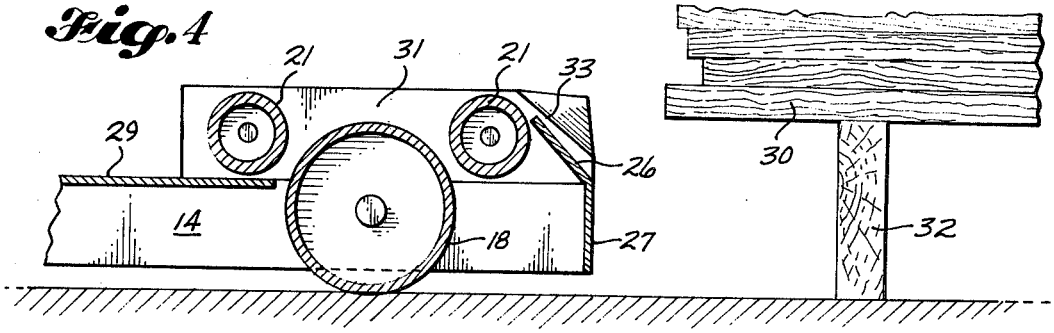
FIG. 4 is a typical cross-sectional view taken along lines 4—4 of FIG. 3.

The lift truck 24 is then positioned facing one side of the stack 30 where the tines 22 are inserted above the side frame members 14 and below the stack to centrally and laterally engage the stack (see FIG. 3). The tines thereafter engage the stack 30 and lift and remove it from the transfer unit for transporting to a desired storage location away from the row of stacks.

After placing the selected stack at the desired storage location, the truck 24 returns to the area of stacks, and the tines 22 are re-engaged with the transfer unit for repositioning in an end aligned relationship with yet a second stack and the process is repeated. Alternatively, a second forklift truck (suitably like truck 24) can engage the transfer unit and engage the unit for withdrawal of another stack from the line of stacks while the first lift truck is in the process of delivering the first stack to the storage area. Alternatively, also, a first forklift truck 24 can be engaged in repetitive manipulation of the transfer unit to successively withdraw stacks from the line of stacks while one or more other lift trucks successively perform the task of transporting the withdrawn stack to one or more storage locations.

It will be obvious to anyone skilled in the art that the teachings of this invention may be used to advantage in any situation where it is necessary to move and transfer a stack of lumber or the like from a row of stacks wherein the stacks are arranged in a close together side-by-side relationship, such as typically exists in a sawmill, lumber yard or other stacked unit generating operation. Therefore, it should be understood by those skilled in the art that various changes and omissions in form and detail thereof may be made therein without departing from the spirit and scope of the present invention, as defined by the following claims.

I claim:

1. A transfer unit facilitating movement by forklift truck of a selected stack of lumber or the like, from a row of such stacks in a closely spaced side by side relationship, each supported on ground placed chocks at each end of each stack, said unit comprising:

(a) a rigid, essentially rectangular frame including side members spaced apart a distance slightly wider than a stack, and cross-members spaced at intervals along the length of said side members, certain of said cross members providing in conjunction with said side members at one end thereof a pocket means for receiving the tines of a forklift truck whereby the unit can be engaged and lifted by said tines;

(b) ground engaging roller means journaled between said side members at the other end thereof, and of a diameter slightly greater than the height of said frame and slightly less than the height of said stack supporting chocks; and, (c) stack engaging and supporting elements superimposed across said frame at intervals along the length thereof, with at least one such supporting element being in the form of roller means spanning the roller supported end of said unit, the height of the upper surface of such stack engaging roller means being slightly greater than the height of said stack supporting chocks so that as the transfer unit is progressively moved under a chock supported stack the weight of the stack is progressively transferred from the chocks to the stack engaged roller means, whereby the stack can be withdrawn from the row of stacks by elevating the transfer unit by a slight raising of the lift tines and by backing the forklift truck away from the row of stacks.

2. The transfer unit as recited in claim 1, wherein the pocket means is disposed between said side members at a length from the tine engaged end of said unit such that the pocket means engages the tip portion of said tines of said forklift truck.

3. The side members as recited in claim 1, further comprising a plurality of tine steering and positioning guides disposed upon and along the inside surface of said side members and between the pocket means and tine engaging end of the unit thereof, said tine steering and positioning guides maintaining the lift truck and transfer unit in an end aligned relation as the tines engage said unit.

4. The transfer unit as recited in claim 1, wherein the ground engaging roller means comprises a rigid drum.

5. The transfer unit as recited in claim 1, further comprising a ramp member superimposed across said frame at the roller supported end thereof, said ramp forming an acute angle with respect to said side members and extending above said side members to a height slightly less than said stack engaging roller means, said ramp engaging and deflecting in an upward manner said stack as said unit is initially moved under said stack.

6. The ramp member as recited in claim 5, further comprising stack guiding members on either side of said ramp member and upon said side members and extending slightly above and slightly forwardly of said ramp, said guiding members having a flared portion at the forward end thereof, said flared portion being slightly wider than the width of said ramp.

7. The transfer unit as recited in claim 1, further comprising a plate superimposed across said frame, said plate disposed between said stack engaging and supporting elements and said stack engaging roller means.

8. The method of moving and transferring a stack of lumber or the like from a row of stacks wherein the stacks are arranged close together in side by side relationship and supported on ground placed chocks positioned at each end of each stack, as is the practice in a sawmill wherein sawn lumber is moved sidewise into a stacking area on a "green line" and is removed from the line and sorted and stacked by hand to accumulate a row of stacks of lumber sorted as by size and the like, said method comprising:

(a) selecting a given stack for removal from the row of stacks;

(b) engaging with the tines of a forklift truck the rear end of a transfer unit provided with a ground engaging support means at its forward end and tine receiving pocket means at its rear end;

(c) lifting the engaged transfer unit with the lift truck tines so tht that the transfer unit is at least partially carried by and maneuverable by movement of the lift truck, and moving the transfer unit into an end aligned, ground engaged position with the stack selected for removal;

(d) moving the transfer unit forwardly and progressively under the selected stack by forward movement of the lift truck so that the forward end of the transfer unit engages and pushes the adjacent stack supporting chock toward and beyond the center of the stack such that the weight of the stack is progressively transferred from the chocks to the transfer unit; and (e) withdrawing the transfer unit supported stack from the row of stacks by backing the lift truck and the tine engaged transfer unit from the row of stacks to the point where the unit supported stack is clear of the row.

9. The method of claim 8 comprising the additional steps of:

(a) lowering the lift truck tines to the point where the transfer unit and stack supported thereby are entirely ground supported, and disengaging the tines from the transfer unit;

(b) moving a lift truck to a position facing one side of the selected stack inserting the lift truck tines below the stack, and lifting the stack from the transfer unit;

(c) transporting the tine supported stack to a storage location away from the row of stacks;

(d) re-engaging the tines of the forklift truck with said transfer unit; and (e) maneuvering the engaged transfer unit to engage, support and withdrawn another selected stack from the row of stacks.

10. The method of claim 9, wherein the lift truck used to lift the withdrawn stack is the same lift truck used to maneuver the transfer unit to withdraw the selected stack from the row of stacks.

11. The method of claim 9, wherein the lift truck used to lift the withdrawn stack is a lift truck other than that used to maneuver the transfer unit to withdraw the selected stack from the row stacks.

12. The method of claim 8 comprising the additional steps of:

(a) lowering the lift truck tines to a point where the transfer unit and stack supported thereby are entirely ground supported, and disengaging the tines from the transfer unit;

(b) moving the lift truck to a position facing one side of the selected stack, inserting the lift truck tines of said lift truck below the stack, and lifting the stack from the transfer unit;

(c) transporting the tine supported stack to a storage location away from the row of stack;

(d) re-engaging the transfer unit with the tines of a second forklift truck while said selected stack is in the process of being transported to said storage location; and (e) maneuvering the engaged transfer unit by said second lift truck to engage, support and withdrawn another selected stack from the row of stacks.

13. The method of claim 8 comprising the additional steps of:

(a) moving a second lift truck to a position facing one side of the selected stack, inserting the lift truck tines below the stack, and lifting the stack from the transfer unit;

(b) transporting the tine supportd stack to a storage location away from the row of stacks;

(c) maneuvering the engaged transfer unit to engage, support and withdraw a second selected stack from the row of stacks while the second lift truck is in the process of delivering the selected stack to said storage location;

(d) moving a third lift truck to a position facing one side of the second selected stack, inserting the lift truck tines below the second stack, and lifting the second stack from the transfer unit;

(e) transporting the tine supported second selected stack to a storage location away from the row of stacks; and (f) maneuvering the engaged transfer unit to engage, support, and withdraw yet another selected stack from the row of stacks.

* * * * *